US006629667B2

(12) United States Patent
Tramontina

(10) Patent No.: US 6,629,667 B2
(45) Date of Patent: Oct. 7, 2003

(54) DISPENSER FOR SHEET MATERIAL

(75) Inventor: Paul Francis Tramontina, Alpharetta, GA (US)

(73) Assignee: Kimberly-Clark Corporation, Neenah, WI (US)

( * ) Notice: Subject to any disclaimer, the term of this patent is extended or adjusted under 35 U.S.C. 154(b) by 0 days.

(21) Appl. No.: 10/035,058

(22) Filed: Dec. 28, 2001

(65) Prior Publication Data

US 2003/0122031 A1 Jul. 3, 2003

(51) Int. Cl.[7] ..... B65H 49/38

(52) U.S. Cl. ..... 242/593; 242/615.3; 206/409; 220/253

(58) Field of Search ..... 242/593, 132, 242/137, 615.3, 615.4; 206/409, 390, 394, 205, 210, 812; 220/253; 221/1, 62, 63

(56) References Cited

U.S. PATENT DOCUMENTS

| | | | |
|---|---|---|---|
| 3,523,653 | A | 8/1970 | Hansen |
| 3,627,216 | A | 12/1971 | Ekuan |
| 3,923,223 | A | 12/1975 | Larsson et al. |
| 4,180,160 | A | 12/1979 | Ogawa et al. |
| 4,262,816 | A | 4/1981 | Margulies |
| 4,289,262 | A | 9/1981 | Finkelstein |
| 4,460,106 | A | 7/1984 | Moulding, Jr. et al. |
| 4,524,895 | A | 6/1985 | Lundén |
| 4,534,491 | A | 8/1985 | Norton et al. |
| 4,579,266 | A | 4/1986 | Bünger et al. |
| D285,995 | S | 10/1986 | Minost |

(List continued on next page.)

FOREIGN PATENT DOCUMENTS

| | | |
|---|---|---|
| DE | 2222357 | 5/1972 |
| DE | 2818757 | 11/1979 |
| EP | 0107487 | 5/1984 |
| EP | 0117567 | 9/1984 |
| EP | 0128127 | 12/1984 |
| EP | 0091411 | 12/1985 |
| EP | 0061248 | 11/1986 |
| EP | 0068722 | 4/1988 |
| EP | 0238460 | 8/1990 |
| EP | 0231183 | 1/1991 |
| EP | 0550863 | 7/1993 |

(List continued on next page.)

OTHER PUBLICATIONS

Abstract for EP 550863, Jul. 14, 1993, Loctite Deut GmbH.
Abstract for DE 2222357, May 6, 1972, Molnlycke GmbH.
Abstract for DE 2818757, Nov. 8, 1979, Daimler–Benz AG.
Abstract for FR 2667853, Apr. 17, 1992, Granger M.
Abstract for FR 2667854, Apr. 17, 1992, Granger M.
Abstract for FR 2668694, May 7, 1992, Granger M.
Abstract for FR 2669818, Jun 5, 1992, Granger M.
American Society for Testing Materials (ASTM) Designation: D 3776–96, "Standard Test Methods for Mass Per Unit Area (Weight) of Fabric," pp. 86–89, published Jun. 1996.
American Society for Testing Materials (ASTM) Designation: D 5035–95, "Standard Test Method For Breaking Force and Elongation of Textile Fabrics (Strip Method)," pp. 682–688, published Jul. 1995.
TAPPI Official Test Method T 411 om–89, "Thickness (Caliper) of Paper, Paperboard, and Combined Board," published by the TAPPI Press, Atlanta, Georgia, revised 1989, pp. 1–3.

*Primary Examiner*—William A. Rivera
(74) *Attorney, Agent, or Firm*—Sue C. Watson

(57) ABSTRACT

A dispenser adapted to dispense sheet material therefrom includes a housing configured to support a sheet material product therein which has an exit port. The dispenser also includes at least a removable orifice plate for controlling the movement of sheet material from the housing through the exit port. Methods of using and adjusting a dispenser having a removable orifice plate.

20 Claims, 6 Drawing Sheets

U.S. PATENT DOCUMENTS

| | | | | |
|---|---|---|---|---|
| D296,765 | S | | 7/1988 | Urion |
| 4,756,460 | A | | 7/1988 | Ornros |
| 4,760,970 | A | * | 8/1988 | Larsson et al. |
| 4,846,415 | A | | 7/1989 | Jernberg et al. |
| 4,905,868 | A | | 3/1990 | Beane et al. |
| 4,979,617 | A | | 12/1990 | Benoit |
| 5,065,924 | A | | 11/1991 | Granger |
| 5,131,561 | A | | 7/1992 | Casperson et al. |
| 5,141,171 | A | | 8/1992 | Yang |
| 5,205,455 | A | | 4/1993 | Moody |
| 5,211,308 | A | | 5/1993 | Decker et al. |
| 5,215,211 | A | | 6/1993 | Eberle |
| 5,219,126 | A | | 6/1993 | Schutz |
| D337,464 | S | | 7/1993 | Giugiaro |
| D339,014 | S | | 9/1993 | Giugiaro |
| D339,015 | S | | 9/1993 | Giugiaro |
| 5,246,137 | A | | 9/1993 | Schutz et al. |
| 5,263,607 | A | | 11/1993 | Temesvary et al. |
| 5,273,184 | A | | 12/1993 | Rizzuto |
| 5,310,083 | A | | 5/1994 | Rizzuto |
| 5,346,064 | A | | 9/1994 | Rizzuto |
| 5,370,338 | A | | 12/1994 | Lewis |
| 5,480,060 | A | | 1/1996 | Blythe |
| 5,560,514 | A | | 10/1996 | Frazier |
| 5,577,634 | A | | 11/1996 | Morand |
| 5,577,635 | A | | 11/1996 | Block |
| 5,582,362 | A | | 12/1996 | Johnson et al. |
| D385,734 | S | | 11/1997 | Mervar et al. |
| 5,715,917 | A | | 2/1998 | Morand |
| 5,715,971 | A | * | 2/1998 | Morand ..... 242/593 |
| 5,749,492 | A | | 5/1998 | Petterson |
| 5,762,286 | A | | 6/1998 | Schutz |
| 5,762,287 | A | | 6/1998 | Schutz |
| 5,765,718 | A | | 6/1998 | Grasso et al. |
| 5,769,354 | A | | 6/1998 | Lindh et al. |
| D396,369 | S | | 7/1998 | Giugiaro |
| 5,785,274 | A | | 7/1998 | Johnson |
| D403,543 | S | | 1/1999 | Grasso et al. |
| 5,857,642 | A | | 1/1999 | Zinnbauer |
| 5,868,346 | A | | 2/1999 | Cobos |
| 6,062,422 | A | | 5/2000 | Ellis |
| 6,082,663 | A | | 7/2000 | Tramontina et al. |
| 6,089,499 | A | | 7/2000 | Robinson |
| 6,129,240 | A | | 10/2000 | Morand |
| 6,145,782 | A | | 11/2000 | King et al. |
| 6,182,858 | B1 | | 2/2001 | Hartog |
| 6,189,726 | B1 | | 2/2001 | Fick |
| 6,267,321 | B1 | | 7/2001 | Tramontina |
| D449,474 | S | | 10/2001 | Conran et al. |
| 6,328,252 | B1 | | 12/2001 | Neveu et al. |
| 6,354,426 | B1 | | 3/2002 | Habisreitinger et al. |

FOREIGN PATENT DOCUMENTS

| | | |
|---|---|---|
| EP | 0480848 | 1/1994 |
| EP | 0740921 A | 11/1996 |
| EP | 0642317 | 2/1997 |
| EP | 0595779 | 4/2000 |
| EP | 1066787 A1 | 1/2001 |
| FR | 2667853 | 4/1992 |
| FR | 2667854 | 4/1992 |
| FR | 2668694 | 5/1992 |
| FR | 2669818 | 6/1992 |
| GB | 1455216 | 11/1976 |
| GB | 2038778 | 7/1980 |
| GB | 2063213 | 6/1981 |
| GB | 2120639 | 12/1983 |
| GB | 2145693 | 9/1986 |
| GB | 2270299 | 3/1994 |
| WO | 93/22963 | 11/1993 |
| WO | 93/22964 | 11/1993 |
| WO | 97/21377 | 6/1997 |

* cited by examiner

DISPENSER FOR SHEET MATERIAL

FIELD OF THE INVENTION

The invention generally relates to dispensers, and more specifically, to dispensers for dispensing sheet material.

BACKGROUND

Dispensers for rolls or stacks of sheet material have an exit port which usually permits one sheet material at a time to be dispensed therethrough. Many dispensers which dispense sheet materials are sufficiently complicated to load and re-load that excessive or inadequate dispensing of sheet materials occurs.

Problems are also caused in many dispensers when different products are used. That is, sheet material products from various manufacturers often have their own characteristics. The caliper and basis weight of the sheet material of each product will likely be different. Further, the machine direction tensile of the sheet material will vary in different products. Moreover, the tab strength of each sheet material will also vary product-to-product. These differing characteristics of each product type often result in excessive or inadequate dispensing of sheet materials as well.

In addition, even when a dispenser is operating properly, it can be difficult for an operator to thread newly loaded sheet material through a small or difficult to access opening in a dispensing port. Therefore, reloading provides difficulties for an operator each time new sheet material is disposed in the dispenser.

It would be advantageous to have a dispenser for sheet material which is rolled, or sheet material which is stacked, which permits an operator to quickly and easily load and thread different product types of sheet material using, for example, one hand, and which and which is easy to adjust for different product types.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "centerflow roll" or "centerflow roll product" means sheet material wound cylindrically about a center, but permitting the removal of material from the center. Desirably, as the centerflow roll is consumed, sheet material eventually dispenses from the roll's periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As user herein, the term "couple" includes, but is not limited to, joining, connecting, fastening, linking, or associating two things integrally or interstitially together.

SUMMARY OF THE INVENTION

In one aspect of the invention, a dispenser adapted to dispense sheet material is provided, and includes a housing having a platform configured to support sheet material thereon. The platform including a removable orifice plate having an opening therein positioned on a first axis. The housing includes an exit port spaced apart from the platform. The exit port is positioned on a second axis. Sheet material disposed in the dispenser flows between the opening in the platform and the exit port on a third axis.

In another aspect of the invention, a dispenser adapted to dispense sheet material is provided, and includes a housing having a platform configured to support sheet material thereon. The platform includes a removable orifice plate having an opening therein. The housing includes an exit port spaced apart from the platform. When sheet material is disposed in the dispenser, the sheet material flows in a generally Z-shaped path from the platform and through the exit port.

In yet another aspect of the invention, a method of installing a sheet material product into a dispenser is provided. A dispenser having an exit port is provided. The dispenser is opened to access a platform provided in the housing which is configured to hold sheet material products. The platform includes a removable orifice plate having an opening therein. The orifice plate is selected to dispense an effective number of sheet material products through the opening and the exit port. A sheet material product is disposed onto the platform. The sheet material product is threaded through the opening in the orifice plate. A leading edge of the sheet material product is extended from the orifice plate. The dispenser is closed and the leading edge of the sheet material product extends from the exit port.

Further, in still yet another aspect of the invention, a dispenser adapted to dispense sheet material is provided, and includes a housing having a platform and an exit port therein. The platform is configured to support sheet material thereon. A removable orifice plate is positioned adjacent the platform for controlling the movement of sheet material disposed in the housing through the exit port.

DETAILED DESCRIPTION

Figure 1:
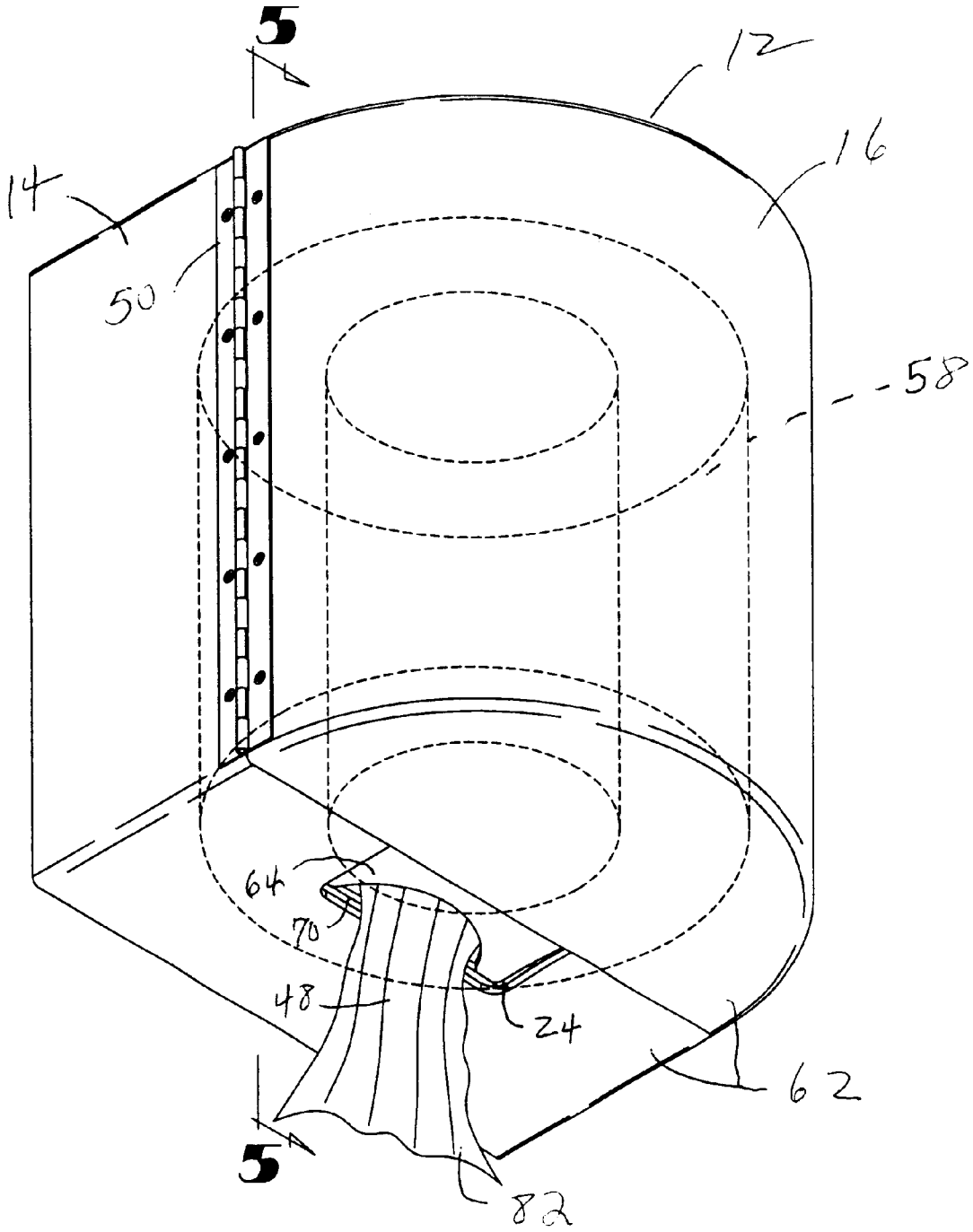
FIG. 1 is a perspective view of a dispenser for sheet material from the lower end of the dispenser, showing a roll of centerflow sheet material disposed in the dispenser (illustrated by phantom lines) and sheet material extending from an exit port.
Figure 2:
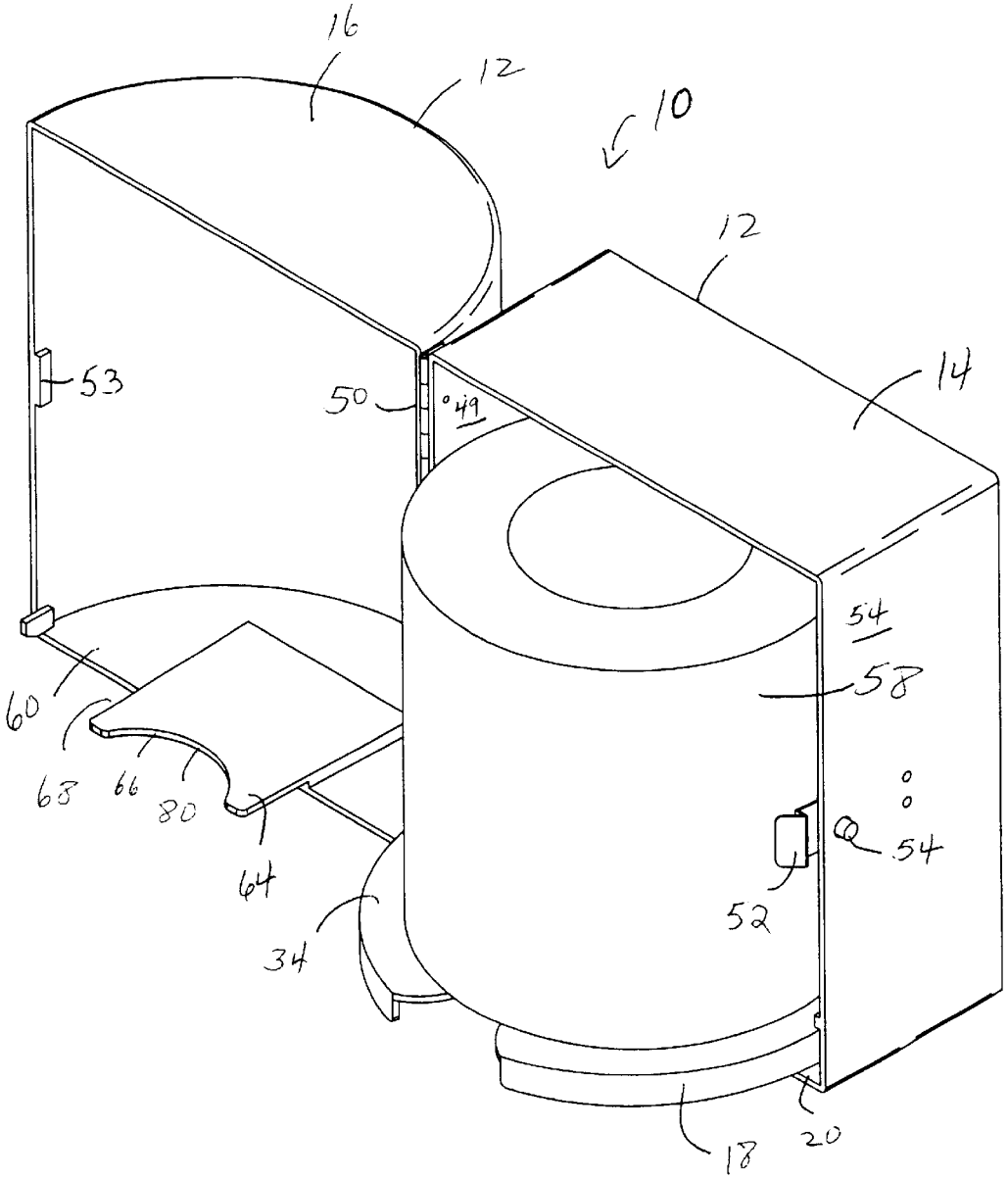
FIG. 2 is an perspective view of the dispenser of FIG. 1, showing the dispenser opened and a roll of centerflow sheet material disposed therein.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Illustrated in FIGS. 1–6 is a dispenser 10 for sheet material. The dispenser 10 includes a dispenser housing 12. The dispenser housing 12 includes a roll housing 14 and a cover 16.

Figure 4:
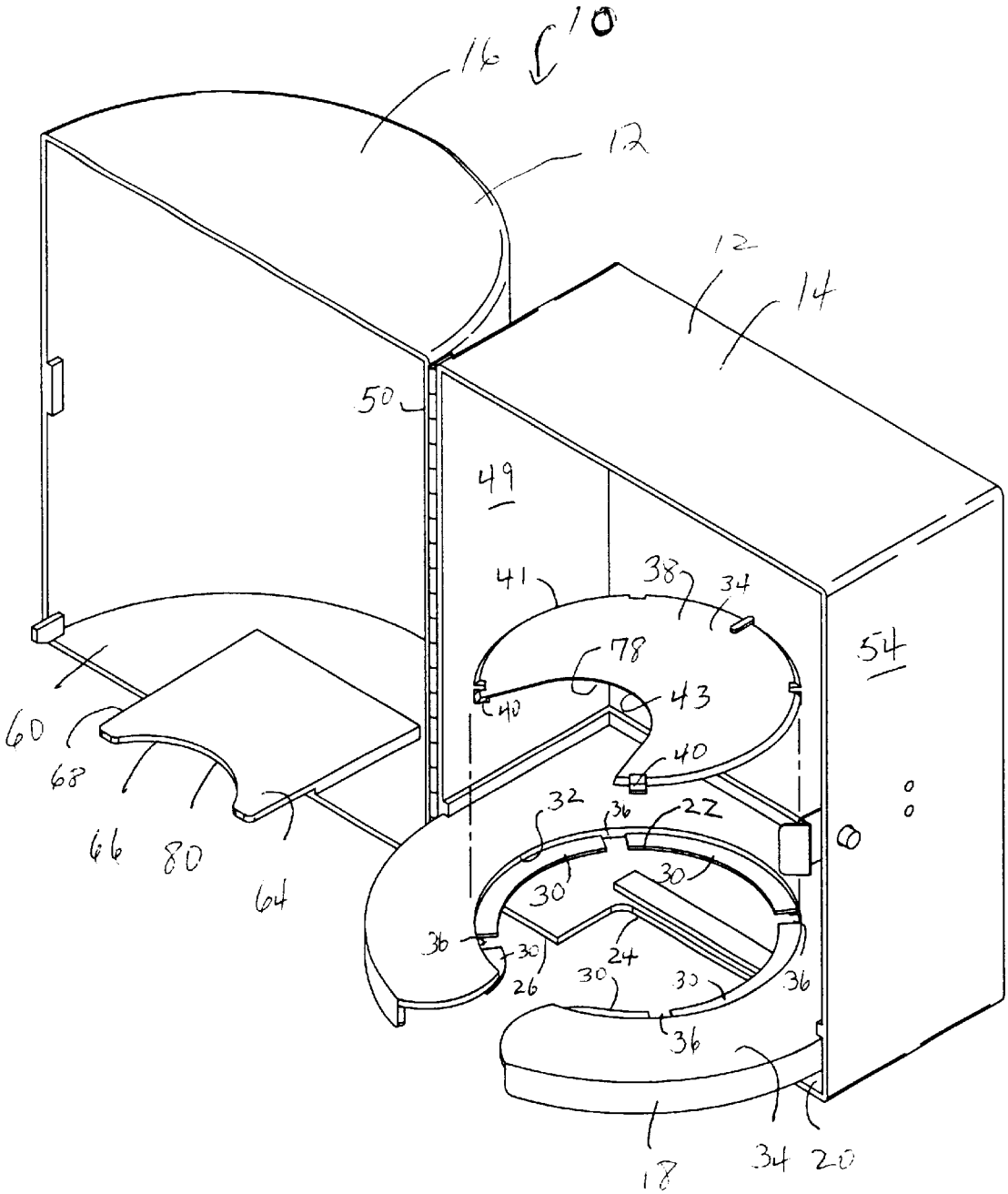
FIG. 4 is an exploded view of the roll platform of the dispenser of FIG. 3, showing an upper orifice plate.
Figure 5:
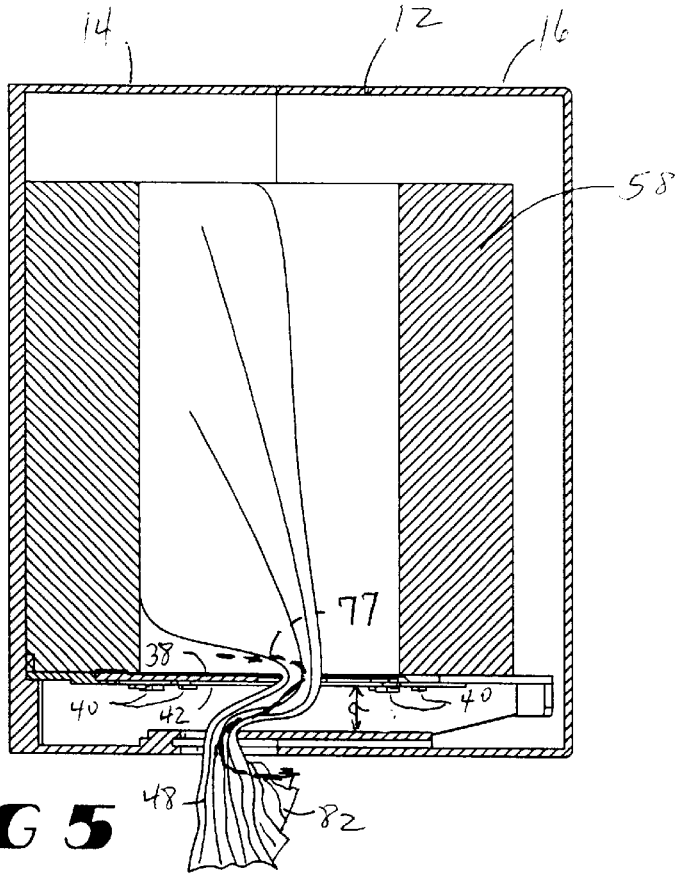
FIG. 5 is a sectional view of FIG. 1 taken along lines 5—5.
Figure 6:
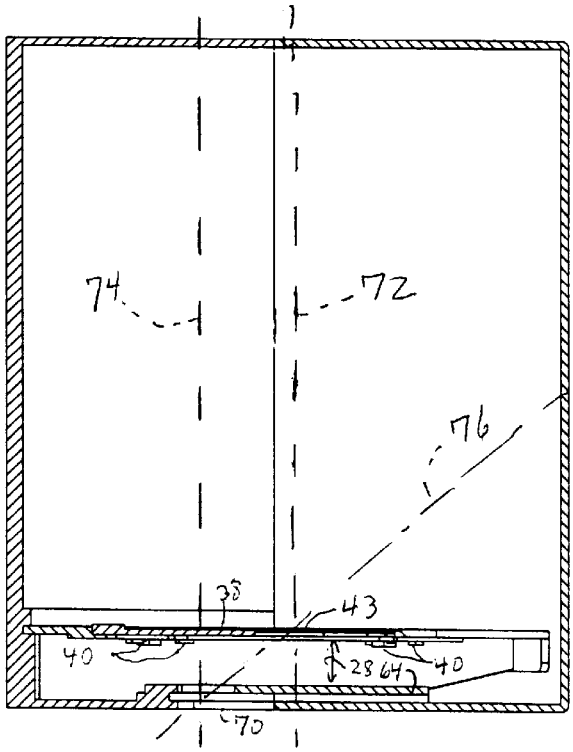
FIG. 6 is a sectional view similar to FIG. 5, but showing the roll of centerflow sheet material removed.
Figure 7:
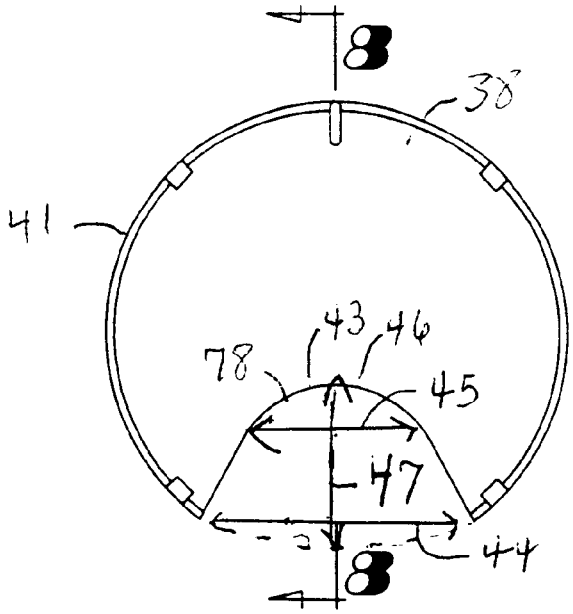
FIG. 7 is a top plan view of one embodiment of the upper orifice plate.
Figure 8:
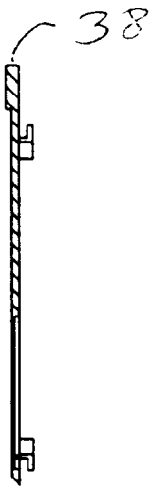
FIG. 8 is a sectional view of FIG. 7 taken along lines 8—8.

The roll housing 14 is configured to permit attachment of the dispenser 10 to a wall or suitable surface (not shown). The roll housing 14 includes a roll platform 18 which is positioned near a lower end 20 of the roll housing 14. As illustrated in FIG. 4, the roll platform 18 includes a slot or opening 22. Another slot 24 is positioned on a front edge 26 of the lower end 20 of the roll housing 14. The roll platform 18 and the lower end 20 are spaced a distance 28 apart (FIGS. 5 and 6). The roll platform 18 also includes a flange member 30 formed along a periphery 32 of the opening 22 and slightly recessed from an upper surface 34 of the roll platform 18. The flange member 30 includes a plurality of spaced-apart slots 36. An upper orifice plate 38 is positioned to lie upon the flange member 30.

Figure 3:
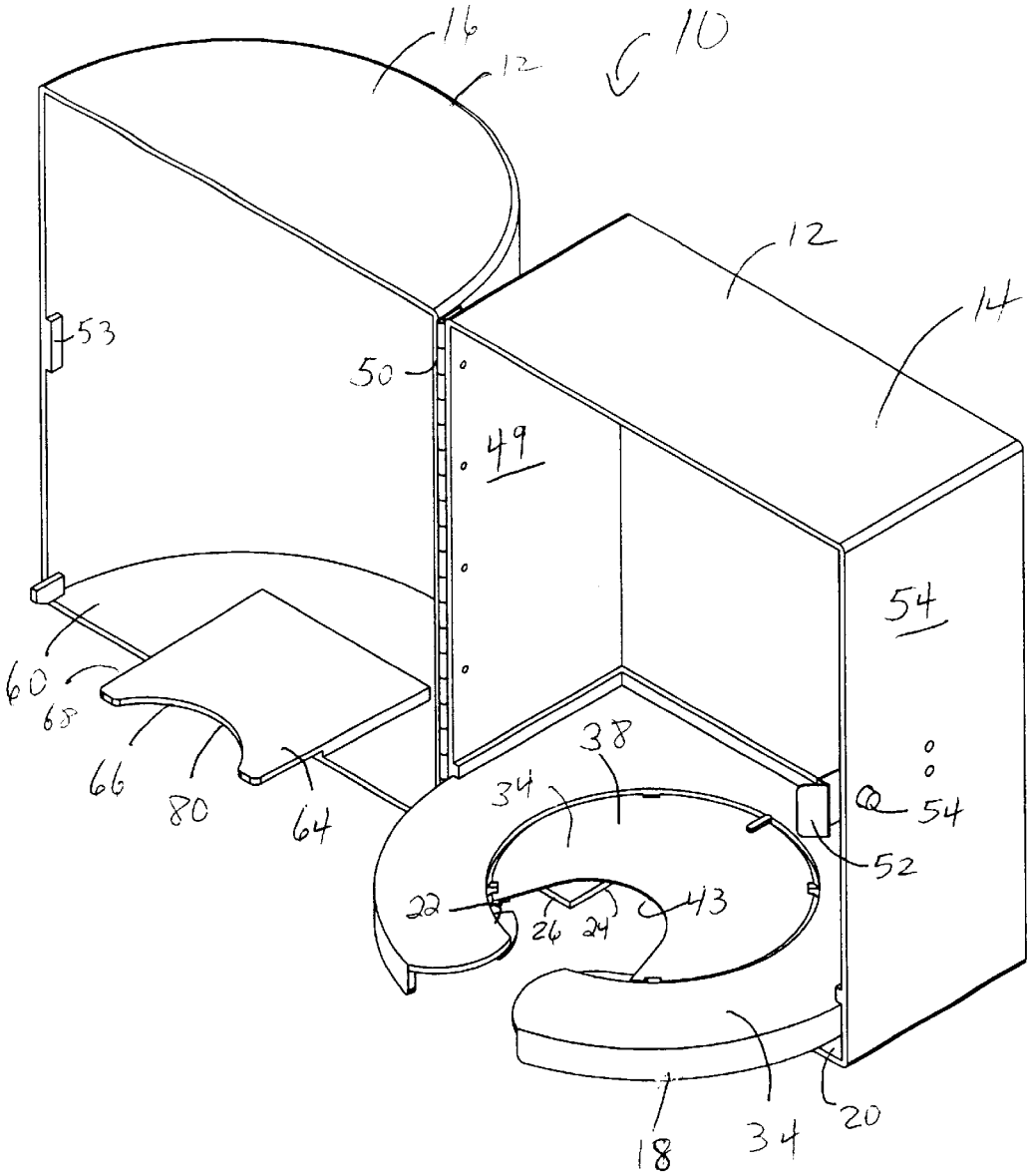
FIG. 3 is an perspective view similar to FIGS. 2, but showing the dispenser housing when the roll of centerflow sheet material is removed.

The upper orifice plate 38, as shown in FIGS. 3–8, is configured to be positioned on the flange member 30 and to conform to a substantial portion of the periphery 32 of the opening 22 of the roll platform 18. The upper orifice plate 38 includes a plurality of tabs 40 positioned about its periphery 41. Each tab 40 is positioned to pass through one slot 36 and extend below the flange member 30. When the upper orifice plate 38 is positioned accordingly and rotated slightly, the tabs 40 slide past the slots 36 and are positioned against a lower surface 42 of the flange member 30 to hold the upper orifice plate 34 in a position for dispensing, as shown in FIGS. 3, 5 and 6.

Figure 9:
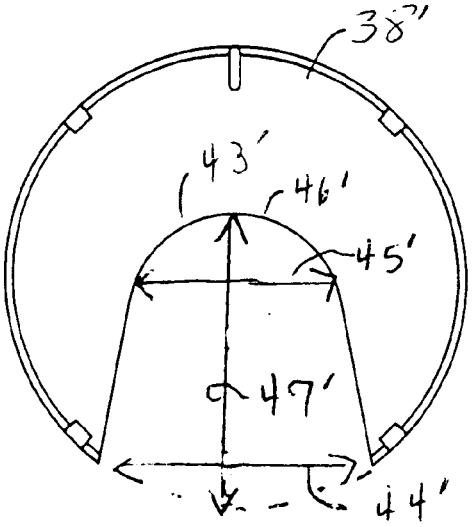
FIG. 9 is a top plan view of another embodiment of an upper oriface plate.

The upper orifice plate 38 in the present embodiment is circular, although other shapes may be used. The upper orifice plate 38 has a concave curved slot 43 formed in the periphery 41 thereof, which forms a widened generally U-shape, as illustrated in FIGS. 3, 4, 7, and 9. That is, each side of the U-shape is a greater distance 44 apart at the top of the widened U-shape, and a lesser distance 45 apart at the lower rounded end 46 of the U-shape. The depth 47 of the U-shaped slot 43, as well as the width of the U-shape, is dictated by the product-type of sheet material 48 positioned in the dispenser 10. For example, a comparison of the upper orifice plate 38 illustrated in FIG. 7 with an alternative upper orifice plate 38' shown in FIG. 9 illustrates the widths 44, 44' of the upper oriface plates 38, 38', respectively are approximately equal, but the depth, 47' of upper orifice plate 38' is greater than is the depth 47 of upper orifice plate 38. The greater depth 47' of the slot 43' of upper orifice plate 38' causes less frictional resistance, and is used with thicker, i.e., greater basis weight, sheet material products. Thinner, namely, lesser basis weight products require a lesser depth 47 of the slot 43 of the orifice face 38. In use, the slot 43 is in alignment with the opening 22 in the roll platform 18, to permit easy threading of sheet material 48 therethrough.

The cover 16, as illustrated in FIGS. 1–6, is coupled to one side 49 of the roll housing 14 via a vertical hinge 50 that is secured to both a portion of the side 49 and a portion of the cover 16. The hinge 50 permits the cover 16 to pivot away from the roll housing 14, to permit complete access to the roll housing 14 and roll platform 18. While a hinge is used in the present embodiment, other fastening means may be used. A fastener 52, 53 is positioned on an opposite side 54 of the roll housing 14 and the cover, respectively, along with a push button release 56, to secure the cover 16 in a closed position, for illustrative purposes. It will be appreciated that a tamper-proof fastener (not shown) will be used to permit only an operator access to the centerflow roll 58 of sheet material 48 contained in the dispenser 10. The cover 16 may be formed from an opaque material, or alternatively, the cover 16, or any portion thereof, may be formed from a clear, tinted, or translucent material, so that a reduction in the centerflow roll 58 disposed in the dispenser 10 can be seen by an operator. The cover 16 is rounded, to at least partially follow the curvature of the centerflow roll 58 of sheet material 48 positioned therein, although other shapes may be used.

The cover 16 has a lower end portion 60 which, together with the lower end 20 of the roll platform 14, forms a lower end 62 of the dispenser housing 12. The lower end portion 60 includes a lower orifice plate 64.

The lower orifice plate 64 has a concave curved slot 66 formed in a perimeter 68 of the lower orifice plate 64, which forms a semi-elliptical shape, although a semi-circular or other shapes may be used. When the lower end 20 of the roll housing 14 and the lower end portion 60 of the cover 16 are brought together to provide a closed dispensing position of the dispenser 10, as illustrated in FIGS. 1, 5, and 6, the lower orifice plate 64 moves into a cooperative position with the slot 24 in the roll housing 14 to provide an exit port 70. In this instance, the exit port 70 includes one semi-elliptical side, and one straight side, but other configurations are possible. In use, the sheet material 48 from the centerflow roll 58 positioned on the roll platform 18 flows through the slot 43 in the upper orifice plate 38 and past the slot 66 in the lower orifice plate 64 which forms a portion of the exit port 70.

The concave portion of the slot 66 of the lower orifice plate 64 is positioned generally facing the concave portion of the slot 43 of the upper orifice plate 38, as illustrated in FIGS. 3 and 4 showing the dispenser 10 opened, but is positioned behind the slot 43 of the upper orifice plate 38 when the dispenser 10 is closed, as illustrated in FIGS. 5–6. Axis 72 extends vertically through the slot 43 of the upper orifice plate 38. Axis 74 extends vertically through the slot 66 of the lower orifice plate 64, and is spaced-apart and parallel to axis 72. An oblique axis 76 extends through both slot 43 of the upper orifice plate 38 and slot 66 of the lower orifice plate 64, intersecting both axis 72 and axis 74. In addition, upper orifice plate 38 is separated from lower orifice plate 64 by the distance 28 between the roll platform 18 and the lower end 20 of the roll housing 14.

As illustrated in FIG. 5, the sheet material 48 follows a generally Z-shaped path 77 as it flows through the slots 43, 66 of the upper and lower orifice plates 38, 64 which results in a frictional resistance of the sheet material 48 caused by the configuration of the path 77, and the resistance of the sheet material 48 against the slot edges 78, 80 of the slots 43, 66, or the non-parallel, spaced-apart orifice plates 38, 64. Frictional resistance is also created by selection of the size and shape of the slots 43, 43' of the upper orifice plates 38, 38'. These characteristics cooperate to provide dispensing of a proper amount of sheet material, i.e., one sheet material at time, thereby avoiding excessive dispensing or under dispensing of sheet material.

In this manner, only a few upper orifice plates 38, 38' are required to provide proper dispensing of a number of different product types. It will be appreciated that in an alternative embodiment, an additional upper orifice plate(s) may be stored in the roll housing 14 (not shown). It will be further appreciated that, in such an alternative, each of the upper and lower orifice plates 38, 64 may be moved to the other's position, so that the orifice plate positioned on the roll platform 18 is fixed, and the orifice plate forming a portion of the exit port 70 is removable to allow orifice plates having different sized slots to be used in that position.

In a method of use of installing a sheet material 48, a dispenser having an exit port is provided. An operator opens the dispenser housing 12 by releasing the cover 16 and moves the cover 16 away from the roll housing 14 so that the roll platform 18 may be accessed. The roll platform 18 includes an upper orifice plate 38 having a slot 43 therein, in which the upper orifice plate 38 including the configuration of the slot 43 is selected by the operator in order to dispense an effective number of sheet material 48 through the slot 43 and the exit port 70. The centerflow roll 58 of sheet material 48 is disposed on the roll platform 18, and a leading edge 82 of the sheet material 48 is threaded through the slot 43 in the upper orifice plate 38; the leading edge 82 is positioned to extended a distance therefrom. The cover 16 of the dispenser housing 12 is then closed, and the leading edge 82 of the sheet material 48 extends from the exit port 70.

In a method of adjusting sheet material 48 flow from a dispenser 10, a dispenser housing 12 is provided which includes a roll platform 18 to support sheet material 48 thereon. The dispenser housing 12 also has an exit port 70. The roll platform 18 is configured to hold a removable upper orifice plate 38 having a slot 43 formed therein. The upper orifice plate 38 is selected in accordance with the sheet material product type, and inserted into the roll platform 18. Sheet material 48 is then loaded onto the roll platform 18 and a leading edge 82 is threaded through the slot 43 in the upper orifice plate 38; a leading edge 82 of the sheet material 48 is extended a distance therefrom. The dispenser housing 12 is closed, and the leading edge 82 extends from the exit port 70.

The dispenser 10 is configured to permit a user to open the dispenser housing 12, select an orifice plate, for example, 38 or 38', and position the selected orifice plate 38 or 38' in the opening 22 of the roll platform 18, while using only one hand. In addition, the dispenser 10 is configured to permit a user to dispose a new centerflow roll 58 of sheet material 48 in the dispenser 10, thread the leading edge 82 of the sheet material 48 through the slot 43 or 43' in the orifice plate 38 or 38' and to close the dispenser housing 12, while using only one hand.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheet material, the dispenser comprising:

a housing including a platform configured to support sheet material thereon, the platform including a removable orifice plate having an opening therein positioned on a first axis, the housing formed to include an exit port spaced apart from the platform, the exit port positioned on a second axis;

wherein sheet material disposed in the dispenser flows between the opening in the platform and the exit port on a third axis.

2. The dispenser of claim 1, wherein the opening in the orifice plate forms a widened U-shape.

3. The dispenser of claim 2, wherein the opening of the orifice plate is configured to dispense a selected thickness of sheet material.

4. The dispenser of claim 1, wherein a portion of the exit port is provided by an orifice plate.

5. The dispenser of claim 4, wherein the orifice plate is formed to provide a semi-elliptical shape.

6. The dispenser of claim 1, wherein the sheet material follows a generally Z-shaped path from the opening in the orifice plate and through the exit port.

7. The dispenser of claim 6, wherein the Z-shaped path causes frictional resistance the assists in dispensing one sheet material at a time from the dispenser.

8. The dispenser of claim 1, wherein a portion of the exit port is provided by an orifice plate.

9. The dispenser of claim 8, wherein the orifice plate is formed to provide a semi-elliptical shape.

10. The dispenser of claim 1, wherein the Z-shaped path causes frictional resistance and assists in dispensing one sheet material at a time from the dispenser.

11. The dispenser of claim 1, wherein the opening in the orifice plate is positioned on a first axis and the exit port is positioned on a second axis.

12. The dispenser of claim 11, wherein the sheet material positioned between the platform and the exit port is disposed on a third axis.

13. A dispenser adapted to dispense sheet material, the dispenser comprising:

a housing including a platform configured to support sheet material thereon, the platform including a removable orifice plate having an opening therein, the housing formed to include an exit port spaced apart from the platform, wherein sheet material disposed in the dispenser flows on a generally Z-shaped path from the platform and through the exit port.

14. The dispenser of claim 13, wherein the opening in the orifice plate forms a widened U-shape.

15. The dispenser of claim 14, wherein the opening of the orifice plate is configured to dispense a selected thickness of sheet material.

16. A dispenser adapted to dispense sheet material, the dispenser comprising:

a housing including a platform and an exit port, the platform configured to support sheet material thereon; and means positioned on the platform for controlling the movement of sheet material disposed in the housing through the exit port, the controlling means including a removable orifice plate having an opening positioned on a first axis and the exit port positioned on a second axis.

17. The dispenser of claim 16 wherein at least a portion of the sheet material moves out of the housing and through the exit port on a third axis.

18. The dispenser of claim 16, wherein a portion of the exit port is provided by an orifice plate.

19. The dispenser of claim 18, wherein the orifice plate is formed to provide a semi-elliptical shape.

20. The dispenser of claim 16, wherein the sheet material moving from the housing and through the exit port follows a circuitous path which causes frictional resistance and assists in dispensing one sheet material at a time from the dispenser.

* * * * *

UNITED STATES PATENT AND TRADEMARK OFFICE

CERTIFICATE OF CORRECTION

PATENT NO. : 6,629,667 B2
DATED : October 7, 2003
INVENTOR(S) : Paul Francis Tramontina It is certified that error appears in the above-identified patent and that said Letters Patent is hereby corrected as shown below:

Title page,
Item [75], Inventor, "Paul Francis Tramontina" should read
-- Paul Francis Tramontina, Jonathan Green and Richard S. Thoma --

Signed and Sealed this

Second Day of March, 2004

JON W. DUDAS
*Acting Director of the United States Patent and Trademark Office*